US008006407B2

(12) United States Patent
Anderson

(10) Patent No.: US 8,006,407 B2
(45) Date of Patent: Aug. 30, 2011

(54) DRYING SYSTEM AND METHOD OF USING SAME

(76) Inventor: Richard Anderson, Rockford, MI (US)

( * ) Notice: Subject to any disclaimer, the term of this patent is extended or adjusted under 35 U.S.C. 154(b) by 900 days.

(21) Appl. No.: 11/954,525

(22) Filed: Dec. 12, 2007

(65) Prior Publication Data

US 2009/0151190 A1 Jun. 18, 2009

(51) Int. Cl.
*F26B 11/00* (2006.01)

(52) U.S. Cl. ..... 34/381; 34/406; 34/413; 34/90; 34/201; 34/218; 34/242; 392/384; 705/14; 96/400; 110/224; 110/233; 431/36; 431/31; 165/217; 165/231

(58) Field of Classification Search ..... 34/381, 34/406, 413, 90, 210, 219, 242; 165/217, 165/231; 705/14; 392/384; 96/400; 431/36, 431/31; 110/224, 233
See application file for complete search history.

(56) References Cited

U.S. PATENT DOCUMENTS

| | | | | | |
|---|---|---|---|---|---|
| 1,703,551 | A | * | 2/1929 | Singer | 15/330 |
| 2,623,364 | A | * | 12/1952 | Munters | 62/92 |
| 2,703,911 | A | * | 3/1955 | Griffin | 52/302.3 |
| 2,758,390 | A | * | 8/1956 | Munters | 34/80 |
| 3,115,567 | A | * | 12/1963 | Meltzer | 392/384 |
| 3,488,960 | A | * | 1/1970 | Kirkpatrick Alton | 60/686 |
| 3,578,064 | A | * | 5/1971 | Mills et al. | 164/437 |
| 3,593,563 | A | * | 7/1971 | Marmor et al. | 374/8 |
| 3,614,074 | A | * | 10/1971 | Wellford, Jr. | 432/48 |
| 3,805,405 | A | * | 4/1974 | Ambos | 34/104 |
| 3,807,290 | A | * | 4/1974 | Eubank | 454/105 |
| 3,898,439 | A | * | 8/1975 | Reed et al. | 700/287 |
| 4,022,570 | A | * | 5/1977 | Ross, Jr. et al. | 432/82 |
| 4,032,365 | A | * | 6/1977 | Bricmont | 148/655 |
| 4,187,688 | A | * | 2/1980 | Berg | 62/235.1 |
| 4,199,952 | A | * | 4/1980 | Berg | 62/143 |
| 4,211,209 | A | * | 7/1980 | Gay | 126/587 |
| 4,213,404 | A | * | 7/1980 | Spaulding | 110/229 |
| 4,231,772 | A | * | 11/1980 | Berg | 62/235.1 |
| 4,261,759 | A | * | 4/1981 | Cawley | 134/6 |
| 4,308,463 | A | * | 12/1981 | Giras et al. | 290/40 R |
| 4,319,626 | A | * | 3/1982 | Papazian et al. | 165/104.12 |
| 4,335,703 | A | * | 6/1982 | Klank | 126/514 |
| 4,367,634 | A | * | 1/1983 | Bolton | 62/238.6 |
| 4,380,146 | A | * | 4/1983 | Yannone et al. | 60/790 |
| 4,391,619 | A | * | 7/1983 | Shono et al. | 65/513 |
| 4,416,418 | A | * | 11/1983 | Goodstine et al. | 237/19 |
| 4,441,922 | A | * | 4/1984 | Most et al. | 75/330 |

(Continued)

FOREIGN PATENT DOCUMENTS

DE 3909340 A1 * 11/1989

(Continued)

*Primary Examiner* — Stephen M. Gravini
(74) *Attorney, Agent, or Firm* — Price Heneveld LLP

(57) ABSTRACT

A drying system (100) for use in drying out a water-damaged structure includes a blower (105) for providing outside air to the water damaged structure. An indirectly fired furnace (101) is used for heating the outside air prior to its introduction into the water-damaged structure. An exhaust blower (114) removes humid air from the water-damaged building, and one or more remote temperature and humidity sensors (117) are used for controlling the furnace air temperature and supply blower volume. An air intake filter box (111) is used for adding make-up air to recirculated building air and promoting cooling within accompanying trailer. A differential air pressure transmitter (118) controls the volume of moist air removed from the water damaged building to an optimal rate.

19 Claims, 2 Drawing Sheets

U.S. PATENT DOCUMENTS

| | | | | |
|---|---|---|---|---|
| 4,534,119 | A * | 8/1985 | Glicksman | 34/95 |
| 4,567,939 | A * | 2/1986 | Dumbeck | 165/224 |
| 4,571,849 | A * | 2/1986 | Gardner et al. | 34/79 |
| 4,706,882 | A * | 11/1987 | Barnard | 236/46 R |
| 4,708,000 | A * | 11/1987 | Besik | 62/480 |
| 4,740,882 | A * | 4/1988 | Miller | 700/3 |
| 4,773,850 | A * | 9/1988 | Bushman et al. | 432/5 |
| 4,793,799 | A * | 12/1988 | Goldstein et al. | 431/79 |
| 4,852,504 | A * | 8/1989 | Barresi et al. | 110/346 |
| 4,945,673 | A * | 8/1990 | Lavelle | 43/124 |
| 4,970,969 | A * | 11/1990 | Koptis et al. | 110/190 |
| 4,993,629 | A * | 2/1991 | Wylie | 236/11 |
| 5,003,961 | A * | 4/1991 | Besik | 126/110 R |
| 5,013,336 | A * | 5/1991 | Kempf et al. | 95/275 |
| 5,082,173 | A * | 1/1992 | Poehlman et al. | 236/11 |
| 5,120,214 | A * | 6/1992 | West et al. | 431/12 |
| 5,155,924 | A * | 10/1992 | Smith | 34/443 |
| 5,199,385 | A * | 4/1993 | Doss | 122/14.22 |
| 5,207,176 | A * | 5/1993 | Morhard et al. | 110/246 |
| 5,261,251 | A * | 11/1993 | Galiyano | 62/176.6 |
| 5,267,897 | A * | 12/1993 | Drees | 454/225 |
| 5,279,637 | A * | 1/1994 | Lynam et al. | 71/12 |
| 5,286,942 | A * | 2/1994 | McFadden et al. | 219/630 |
| 5,318,754 | A * | 6/1994 | Collins et al. | 422/109 |
| 5,341,986 | A * | 8/1994 | Galba et al. | 236/11 |
| 5,408,759 | A * | 4/1995 | Bass | 34/104 |
| 5,419,059 | A * | 5/1995 | Guasch | 34/443 |
| 5,428,906 | A * | 7/1995 | Lynam et al. | 34/379 |
| 5,466,015 | A * | 11/1995 | Berenter | 285/140.1 |
| 5,553,662 | A * | 9/1996 | Longardner et al. | 165/202 |
| 5,555,643 | A * | 9/1996 | Guasch | 34/443 |
| 5,557,873 | A * | 9/1996 | Lynam et al. | 34/379 |
| 5,590,478 | A * | 1/1997 | Furness | 34/437 |
| 5,637,175 | A * | 6/1997 | Feygin et al. | 156/264 |
| 5,706,191 | A * | 1/1998 | Bassett et al. | 700/9 |
| 5,752,328 | A * | 5/1998 | Yamamoto | 34/418 |
| 5,761,827 | A * | 6/1998 | Guasch | 34/413 |
| 5,801,940 | A * | 9/1998 | Russ et al. | 700/9 |
| 5,816,491 | A * | 10/1998 | Berkeley et al. | 236/46 R |
| 5,875,565 | A * | 3/1999 | Bowman | 34/666 |
| 5,876,550 | A * | 3/1999 | Feygin et al. | 156/264 |
| 5,893,216 | A * | 4/1999 | Smith et al. | 34/103 |
| 5,911,747 | A * | 6/1999 | Gauthier | 62/176.6 |
| 5,924,390 | A * | 7/1999 | Bock | 122/17.2 |
| 5,933,702 | A * | 8/1999 | Goswami | 422/186.3 |
| 5,943,789 | A * | 8/1999 | Yamamoto | 34/418 |
| 5,960,556 | A * | 10/1999 | Jansen | 34/402 |
| 5,964,985 | A * | 10/1999 | Wootten | 201/40 |
| 5,980,846 | A * | 11/1999 | Tatani et al. | 423/230 |
| 5,980,984 | A * | 11/1999 | Modera et al. | 427/237 |
| 5,985,474 | A * | 11/1999 | Chen et al. | 429/410 |
| 6,013,158 | A * | 1/2000 | Wootten | 202/99 |
| 6,029,462 | A * | 2/2000 | Denniston | 62/94 |
| 6,059,016 | A * | 5/2000 | Rafalovich et al. | 165/41 |
| 6,061,604 | A * | 5/2000 | Russ et al. | 700/90 |
| 6,062,482 | A * | 5/2000 | Gauthier et al. | 236/11 |
| RE36,921 | E * | 10/2000 | Bushman et al. | 432/5 |
| 6,131,653 | A * | 10/2000 | Larsson | 165/228 |
| 6,176,436 | B1 * | 1/2001 | Gauthier et al. | 236/51 |
| 6,325,001 | B1 * | 12/2001 | Sheldon | 110/342 |
| 6,328,095 | B1 * | 12/2001 | Felber et al. | 165/54 |
| 6,421,931 | B1 * | 7/2002 | Chapman | 34/424 |
| 6,453,687 | B2 * | 9/2002 | Sharood et al. | 62/127 |
| 6,457,258 | B1 * | 10/2002 | Cressy et al. | 34/443 |
| 6,474,084 | B2 * | 11/2002 | Gauthier et al. | 62/158 |
| 6,485,296 | B1 * | 11/2002 | Bender et al. | 432/58 |
| 6,497,856 | B1 * | 12/2002 | Lomax et al. | 423/651 |
| 6,623,719 | B2 * | 9/2003 | Lomax et al. | 423/652 |
| 6,637,667 | B2 * | 10/2003 | Gauthier et al. | 236/10 |
| 6,647,639 | B1 * | 11/2003 | Storrer | 34/104 |
| 6,656,410 | B2 * | 12/2003 | Hull et al. | 264/401 |
| 6,662,467 | B2 | 12/2003 | Cressy et al. | |
| 6,681,584 | B1 * | 1/2004 | Conner | 62/171 |
| 6,740,437 | B2 * | 5/2004 | Ballantine et al. | 429/431 |
| 6,742,284 | B2 * | 6/2004 | Dinh | 34/514 |
| 6,771,916 | B2 * | 8/2004 | Hoffman et al. | 399/92 |
| 6,779,577 | B1 * | 8/2004 | Kaneko et al. | 156/543 |
| 6,782,947 | B2 * | 8/2004 | de Rouffignac et al. | 166/245 |
| 6,835,483 | B2 * | 12/2004 | Ballantine et al. | 429/435 |
| 6,860,288 | B2 * | 3/2005 | Uhler | 137/552 |
| 6,865,926 | B2 * | 3/2005 | O'Brien et al. | 73/23.27 |
| 6,866,092 | B1 * | 3/2005 | Molivadas | 165/104.21 |
| 6,877,555 | B2 * | 4/2005 | Karanikas et al. | 166/245 |
| 6,880,633 | B2 * | 4/2005 | Wellington et al. | 166/245 |
| 6,895,145 | B2 * | 5/2005 | Ho | 385/35 |
| 6,915,850 | B2 * | 7/2005 | Vinegar et al. | 166/272.2 |
| 6,918,442 | B2 * | 7/2005 | Wellington et al. | 166/245 |
| 6,918,443 | B2 * | 7/2005 | Wellington et al. | 166/245 |
| 6,923,257 | B2 * | 8/2005 | Wellington et al. | 166/245 |
| 6,929,067 | B2 * | 8/2005 | Vinegar et al. | 166/302 |
| 6,932,155 | B2 * | 8/2005 | Vinegar et al. | 166/245 |
| 6,934,862 | B2 * | 8/2005 | Sharood et al. | 713/300 |
| 6,939,635 | B2 * | 9/2005 | Ballantine et al. | 429/436 |
| 6,945,179 | B2 * | 9/2005 | Ramme et al. | 110/165 A |
| 6,948,562 | B2 * | 9/2005 | Wellington et al. | 166/272.1 |
| 6,951,247 | B2 * | 10/2005 | de Rouffignac et al. | 166/245 |
| 6,964,300 | B2 * | 11/2005 | Vinegar et al. | 166/245 |
| 6,966,374 | B2 * | 11/2005 | Vinegar et al. | 166/272.3 |
| 6,968,295 | B1 * | 11/2005 | Carr | 702/188 |
| 6,969,123 | B2 * | 11/2005 | Vinegar et al. | 299/3 |
| 6,981,385 | B2 * | 1/2006 | Arshansky et al. | 62/155 |
| 6,981,548 | B2 * | 1/2006 | Wellington et al. | 166/245 |
| 6,986,469 | B2 * | 1/2006 | Gauthier et al. | 236/51 |
| 6,991,032 | B2 * | 1/2006 | Berchenko et al. | 166/245 |
| 6,991,033 | B2 * | 1/2006 | Wellington et al. | 166/245 |
| 6,991,036 | B2 * | 1/2006 | Sumnu-Dindoruk et al. | 166/302 |
| 6,991,045 | B2 * | 1/2006 | Vinegar et al. | 175/45 |
| 6,994,169 | B2 * | 2/2006 | Zhang et al. | 166/302 |
| 6,996,999 | B2 * | 2/2006 | Wacker | 62/158 |
| 6,997,518 | B2 * | 2/2006 | Vinegar et al. | 299/5 |
| 7,004,247 | B2 * | 2/2006 | Cole et al. | 166/60 |
| 7,004,251 | B2 * | 2/2006 | Ward et al. | 166/245 |
| 7,008,559 | B2 * | 3/2006 | Chen | 252/301.6 S |
| 7,011,154 | B2 * | 3/2006 | Maher et al. | 166/245 |
| 7,013,972 | B2 * | 3/2006 | Vinegar et al. | 166/257 |
| 7,029,620 | B2 * | 4/2006 | Gordon et al. | 264/465 |
| 7,032,660 | B2 * | 4/2006 | Vinegar et al. | 166/245 |
| 7,040,397 | B2 * | 5/2006 | de Rouffignac et al. | 166/245 |
| 7,040,398 | B2 * | 5/2006 | Wellington et al. | 166/245 |
| 7,040,399 | B2 * | 5/2006 | Wellington et al. | 166/245 |
| 7,040,400 | B2 * | 5/2006 | de Rouffignac et al. | 166/245 |
| 7,047,664 | B1 * | 5/2006 | Martinez | 34/380 |
| 7,051,807 | B2 * | 5/2006 | Vinegar et al. | 166/245 |
| 7,051,808 | B1 * | 5/2006 | Vinegar et al. | 166/250.1 |
| 7,051,811 | B2 * | 5/2006 | de Rouffignac et al. | 166/302 |
| 7,055,600 | B2 * | 6/2006 | Messier et al. | 166/250.01 |
| 7,063,145 | B2 * | 6/2006 | Veenstra et al. | 166/250.01 |
| 7,066,254 | B2 * | 6/2006 | Vinegar et al. | 166/245 |
| 7,066,257 | B2 * | 6/2006 | Wellington et al. | 166/272.2 |
| 7,077,198 | B2 * | 7/2006 | Vinegar et al. | 166/245 |
| 7,077,199 | B2 * | 7/2006 | Vinegar et al. | 166/250.01 |
| 7,080,505 | B2 * | 7/2006 | Koermer et al. | 60/274 |
| 7,086,465 | B2 * | 8/2006 | Wellington et al. | 166/272.1 |
| 7,090,013 | B2 * | 8/2006 | Wellington | 166/267 |
| 7,096,942 | B1 * | 8/2006 | de Rouffignac et al. | 166/245 |
| 7,100,994 | B2 * | 9/2006 | Vinegar et al. | 299/7 |
| 7,104,319 | B2 * | 9/2006 | Vinegar et al. | 166/245 |
| 7,105,428 | B2 * | 9/2006 | Pan et al. | 438/584 |
| 7,114,343 | B2 * | 10/2006 | Kates | 62/126 |
| 7,114,566 | B2 * | 10/2006 | Vinegar et al. | 166/256 |
| 7,128,153 | B2 * | 10/2006 | Vinegar et al. | 166/285 |
| 7,143,762 | B2 * | 12/2006 | Harrison et al. | 126/589 |
| 7,156,176 | B2 * | 1/2007 | Vinegar et al. | 166/302 |
| 7,165,615 | B2 * | 1/2007 | Vinegar et al. | 166/302 |
| 7,191,489 | B1 * | 3/2007 | Heath | 15/320 |
| 7,201,006 | B2 * | 4/2007 | Kates | 62/129 |
| 7,220,365 | B2 * | 5/2007 | Qu et al. | 252/70 |
| 7,225,866 | B2 * | 6/2007 | Berchenko et al. | 166/245 |
| 7,231,967 | B2 * | 6/2007 | Haglid | 165/231 |
| 7,242,574 | B2 * | 7/2007 | Sullivan | 361/679.21 |
| 7,243,050 | B2 * | 7/2007 | Armstrong | 702/188 |
| 7,244,294 | B2 * | 7/2007 | Kates | 96/417 |
| 7,247,274 | B1 * | 7/2007 | Chow | 422/504 |
| 7,257,987 | B2 * | 8/2007 | O'Brien et al. | 73/23.41 |
| 7,264,649 | B1 * | 9/2007 | Johnson et al. | 95/10 |
| 7,275,377 | B2 * | 10/2007 | Kates | 62/129 |
| 7,275,533 | B2 * | 10/2007 | Soeholm et al. | 126/299 R |

| | | | | |
|---|---|---|---|---|
| 7,276,307 | B2 * | 10/2007 | Ballantine et al. | 429/437 |
| 7,285,346 | B2 * | 10/2007 | Ballantine et al. | 429/436 |
| 7,318,382 | B2 * | 1/2008 | Kaneko | 110/346 |
| 7,322,205 | B2 * | 1/2008 | Bourne et al. | 62/305 |
| 7,331,187 | B2 * | 2/2008 | Kates | 62/129 |
| 7,331,759 | B1 * | 2/2008 | Tejeda | 415/221 |
| 7,332,236 | B2 * | 2/2008 | Ballantine et al. | 429/434 |
| 7,334,345 | B2 * | 2/2008 | Lasonde | 34/181 |
| 7,338,548 | B2 * | 3/2008 | Boutall | 95/14 |
| 7,343,751 | B2 * | 3/2008 | Kates | 62/129 |
| 7,343,960 | B1 * | 3/2008 | Frasier et al. | 164/133 |
| 7,357,831 | B2 * | 4/2008 | Dancey et al. | 96/400 |
| 7,375,309 | B2 * | 5/2008 | Morrow et al. | 219/710 |
| 7,384,588 | B2 * | 6/2008 | Gordon et al. | 264/465 |
| 7,418,993 | B2 * | 9/2008 | Frasier et al. | 164/335 |
| 7,424,343 | B2 * | 9/2008 | Kates | 700/276 |
| 7,454,269 | B1 * | 11/2008 | Dushane et al. | 700/276 |
| 7,461,691 | B2 * | 12/2008 | Vinegar et al. | 166/60 |
| 7,469,546 | B2 * | 12/2008 | Kates | 62/129 |
| 7,469,550 | B2 * | 12/2008 | Chapman et al. | 62/157 |
| 7,516,622 | B2 * | 4/2009 | Gauthier et al. | 62/157 |
| 7,523,762 | B2 * | 4/2009 | Buezis et al. | 137/613 |
| 7,538,297 | B2 * | 5/2009 | Anderson et al. | 219/260 |
| 7,558,452 | B2 * | 7/2009 | Ho | 385/35 |
| 7,574,871 | B2 * | 8/2009 | Bloemer et al. | 62/176.6 |
| 7,575,784 | B1 * | 8/2009 | Bi et al. | 427/567 |
| 7,615,970 | B1 * | 11/2009 | Gimlan | 320/166 |
| 7,621,171 | B2 * | 11/2009 | O'Brien | 73/23.41 |
| 7,733,635 | B2 * | 6/2010 | Sullivan | 361/679.02 |
| 7,735,935 | B2 * | 6/2010 | Vinegar et al. | 299/5 |
| 7,779,890 | B2 * | 8/2010 | Frasier et al. | 164/335 |
| 7,783,400 | B1 * | 8/2010 | Zimler | 701/36 |
| 7,785,098 | B1 * | 8/2010 | Appleby et al. | 425/470 |
| 7,789,317 | B2 * | 9/2010 | Votaw et al. | 236/1 B |
| 7,823,582 | B2 * | 11/2010 | Harrison et al. | 126/589 |
| 7,824,494 | B2 * | 11/2010 | Frasier et al. | 117/200 |
| 7,850,778 | B2 * | 12/2010 | Lemaire | 118/715 |
| 7,856,853 | B2 * | 12/2010 | Evans et al. | 65/377 |
| 7,871,062 | B1 * | 1/2011 | Montreuil et al. | 261/129 |
| 7,885,917 | B2 * | 2/2011 | Kuhns et al. | 706/48 |
| 7,891,114 | B2 * | 2/2011 | Lasonde | 34/331 |
| 7,893,413 | B1 * | 2/2011 | Appleby et al. | 250/505.1 |
| 7,911,326 | B2 * | 3/2011 | Sutardja | 34/494 |
| 2002/0088139 | A1 * | 7/2002 | Dinh | 34/467 |
| 2009/0151190 | A1 * | 6/2009 | Anderson | 34/427 |

FOREIGN PATENT DOCUMENTS

| | | | | |
|---|---|---|---|---|
| EP | 296480 | A2 | * | 12/1988 |
| EP | 327650 | A1 | * | 8/1989 |
| GB | 2229652 | A | * | 10/1990 |
| GB | 2233668 | A | * | 1/1991 |
| JP | 57165017 | A | * | 10/1982 |
| JP | 58055608 | A | * | 4/1983 |
| JP | 58184415 | A | * | 10/1983 |
| JP | 59161611 | A | * | 9/1984 |
| JP | 59161612 | A | * | 9/1984 |
| JP | 60129124 | A | * | 7/1985 |
| JP | 61217618 | A | * | 9/1986 |
| JP | 03196874 | A | * | 8/1991 |
| JP | 06094366 | A | * | 4/1994 |
| JP | 07071873 | A | * | 3/1995 |
| JP | 10148467 | A | * | 6/1998 |
| JP | 11051560 | A | * | 2/1999 |
| JP | 11197565 | A | * | 7/1999 |
| JP | 2000088227 | A | * | 3/2000 |
| JP | 2000234862 | A | * | 8/2000 |
| JP | 2002180066 | A | * | 6/2002 |
| JP | 2007301425 | A | * | 11/2007 |
| JP | 2008229467 | A | * | 10/2008 |
| JP | 2008232516 | A | * | 10/2008 |
| WO | WO 8700604 | A1 | * | 1/1987 |

* cited by examiner

DRYING SYSTEM AND METHOD OF USING SAME

FIELD OF THE INVENTION

The present invention relates generally to processes for drying out water damaged buildings and, more particularly, to equipment process control and air flow management improvements to speed the drying process.

BACKGROUND OF THE INVENTION

Refrigerant and desiccant dehumidifiers are the most common means used to remove moisture and humidity from water-damaged residential and commercial buildings. They are "closed" systems in that the building's air is continuously recycled through the dehumidifier and no outside air is introduced to the process. Dehumidifiers remove moisture from the air and lower the relative humidity which speeds the evaporation process. Dehumidification systems have a number of shortcomings. The time taken to process a wet building's air for lowering the relative humidity levels to acceptable levels for drying to begin can be in excess of 24 hours. Because this air is recycled, unpleasant odors are slow to dissipate. Mold spores and other air contaminates are not removed and risk being spread throughout the building. Dehumidifiers have a very limited temperature operating range and perform poorly below 50° F. and above 85° F. Humidifiers are usually operated at normal building temperature levels of 72° F., a temperature level which is also conducive to mold growth. Still yet another problem associated with the use of dehumidifiers is their consumption of large amounts of electrical power.

Recently, techniques utilizing heat to dry water-damaged structures have been developed. One type of system is comprised of a boiler, heat transfer fluid, and heat exchangers. The boiler, located outside the building, heats a fluid which is pumped through hoses to heat exchangers located in the structure. Heat exchanger fans blow room air through the heat exchanger which warms the air and lowers the relative humidity. The heat and lowered relative humidity accelerate the evaporation process. Exhaust fans remove the hot, moist air from the structure. The volume of air exhausted and replaced with fresh, outside air is sometimes controlled by a humidity sensor.

A second type of system uses hot air as the heat exchange medium. Located outside the structure being dried, fresh air is drawn into a trailer-mounted furnace, heated and reduced in relative humidity, and then blown into the water damaged structure. The hot, dry air heats water molecules by convection and accelerates evaporation. An exhaust fan removes the warm, moist air and exhausts it to atmosphere. Because fresh, outside air is used to replace the building's air, hot air dries are considered "open" systems.

"Open" hot air systems offer a number of advantages over dehumidification. By displacing the building's moist air rather than dehumidifying the air, the relative humidity level in the building can be reduced to below 40% within an hour or two and drying can begin. The introduction of fresh air removes odors associated with dank, wet air. Heat is especially effective at drying contents such as fabrics, books, and furniture. A rule of thumb says for every 10° C. temperature rise, the evaporation rate is doubled. Open hot air systems typically raise building temperatures by 15° to 20° C. over the standard 72° F. Wet buildings are always at a risk of developing mold problems. Hot air system drying temperatures are well above the 50° to 80° F. range for mold growth.

While effective drying tools, as developed, open hot air systems are not without weaknesses. Open systems require a balanced air flow into and out of the building in a managed circulation pattern for optimal performance, but the systems have no means to control air flow. The supply and exhaust blowers are located within the drying trailer, and lengthy runs of flexible duct are required to deliver fresh hot air and remove moist air from the building. Besides being inconvenient to install, lengthy runs of flexible duct greatly reduce air volumes thereby putting the system out of balance. Differing lengths of hose and the route of the hoses put differing static pressure loads on the blowers for which they do not compensate. Also, the trailer location sometimes makes optimal exhaust duct positioning impossible.

The very nature of "open" drying systems makes achieving high levels of thermal efficiency problematic. There are but two temperature sensors controlling heat output of the furnace and no means to measure or automatically control air flow volumes. The temperature sensors are both located within the trailer, not in the structure being dried. One sensor is placed in the hot air stream exiting the furnace and one is in the building exhaust air stream entering the trailer. The furnace sensor signal is used for controlling the furnace's heat output to an operator-selected set point. The exhaust stream temperature sensor is used to prevent overheating of the structure. A high limit set point is operator-selected and an exhaust duct signal at the limit will override the furnace output temperature control. However, because the exhaust air cools as it travels through the flexible duct, especially once outside the building, the exhaust air temperature entering the trailer is considerably lower than the actual building temperature.

The lack of air flow controls also contributes to "open" air drying system inefficiencies. These systems typically operate at a constant air flow volume with equal amounts of air being introduced into the building and being exhausted. As a water-damaged structure dries, the volume of moisture evaporating declines and the relative humidity of the air being exhausted from the building likewise declines. Consequently, low humidity air along with a great deal of heat energy is often exhausted to atmosphere.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
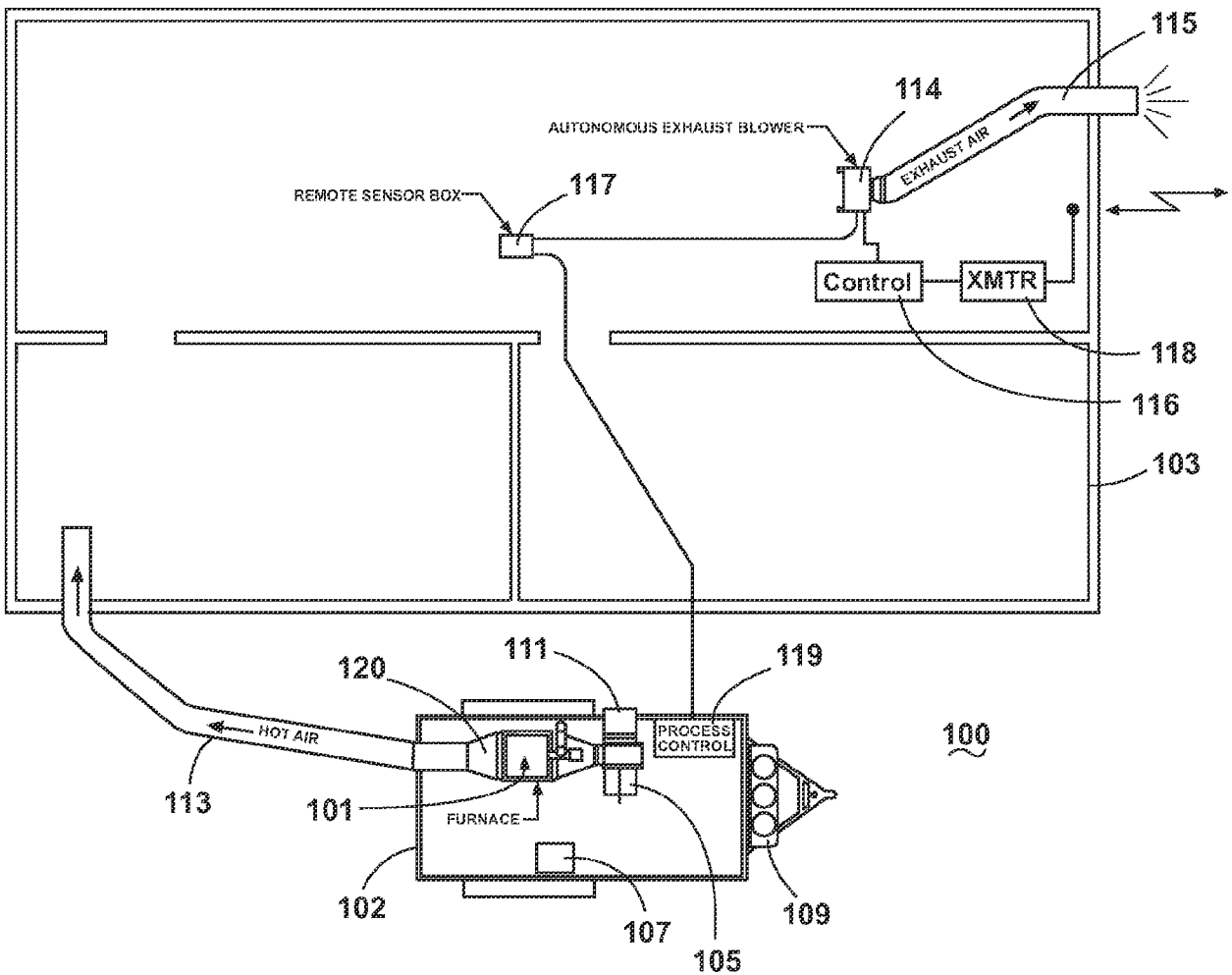
FIG. 1 is a block diagram illustrating the drying system in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a drying system.

Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

An embodiment of the present invention is directed to a drying system which provides an enhanced drying process through the use of modern sensors and control devices. Additionally, an autonomous portable exhaust blower removes moist air from the building and balances air flows and pressure. As seen in FIG. 1, the drying system 100 includes an indirectly fired mobile furnace 101 that can be trailered to the location of water-damaged building 103. Included with the furnace 101 is an air blower with motor 105 and an electric generator 107 for powering these and other devices. Propane tanks 109 provide fuel for the furnace and generator for up to 35 hours. This system is carried on a wheeled trailer 102 that may be towed behind a powered vehicle.

In operation, fresh air is input by blower 105 to the furnace 101 through a air intake filter box 111 where it is heated to a desired temperature and sent through hot air ducting 113 to a point interior to the building 103. The filter box 111 can be configured to use return air from building 103 to which the filter box 111 combines or adds "make up" air with air from the trailered furnace 101. A secondary function of the filter box 111 is to promote air circulation within the trailered furnace 101 and keep the trailer's interior at a relatively cool temperature. Those skilled in the art will recognize the furnace 101 may utilize various sizes and different fuels. For example, a propane fueled 250,000 input British thermal unit (BTU) duct furnace is coupled with a 2,800 cubic feet per minute (CFM) backward inclined blower. Removing humid air from the building 103, autonomous exhaust blower 114 uses an exhaust hose 115 and may operate from within the trailer or from inside or outside the building 103. Incorporated with the autonomous exhaust system is a controller 116 and pressure differential transmitter 118 which modulates the volume of exhausted building air to maintain the building air pressure at the desired set point such that the air pressure may be positive, negative, or neutral. It should be recognized that the exhaust system is capable of running independently of the furnace trailer 101.

The system further includes a remote sensor unit 117 which includes sensor-transmitters for detecting relative humidity, air pressure, and air temperature and transmitting or telemetering this information to a central location. The sensor unit 117 is positioned in a predetermined location within the water damaged structure. Information from the remote sensor unit 117 is used by a process control unit 119. Control signals and/or other telemetry from these sensors are relayed to and processed by the process control unit 119, which modulates the furnace output temperature as well as controls the volume of hot supply air. A maximum furnace output temperature is set at control unit 119 which receives a signal from furnace duct sensor 120.

Figure 2:
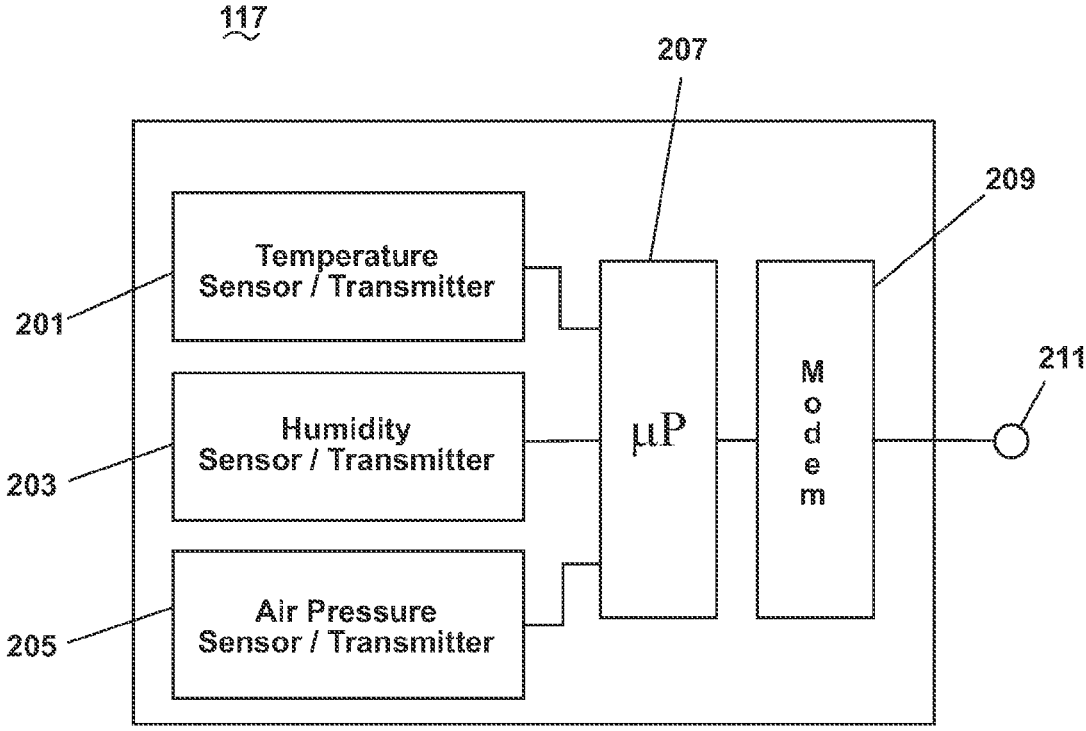
FIG. 2 is a block diagram illustrating details of the remote sensors station as shown in FIG. 1.

FIG. 2 is a block diagram illustrating details of the remote sensor 117 that is used for managing temperature, humidity, and air volume. The remote sensor 117 includes a temperature sensor 201, humidity sensor 203, and air pressure sensor 205 whose outputs are supplied to a microprocessor (uP) 207. The uP 207 operates to interpret the voltage and/or current reading of the temperature sensor 201, humidity sensor 203 and air pressure sensor 205 which are then used to supply control commands to a modem 209. The modem 209 works to convert and/or provide this control information and/or data to an output 211. This data may be supplied to the processor controller 119 by a wired link or through the use of a radio frequency (RF) link using an Institute of Electrical and Electronics Engineers (IEEE) 802.11 WiFi standard or the like. It will be evident to skilled artisans that although shown in the figure, pressure sensor 205 is an option to enhance the functionality of the system in those rare situations when positive air pressures may cause air from water damage affected areas to infiltrate non-affected areas.

Those skilled in the art will recognize there may be several methods for controlling the temperature of heated supply air. The present art method utilizes temperature sensors located on the trailer in the furnace hot air duct and in the building exhaust air duct. Both have operator selectable set points. The furnace set point determines the temperature of the air exiting the furnace. The exhaust air temperature correlates to the temperature inside the water-damaged structure. In the case of a temperature exceeding the exhaust air set point, the exhaust air controller will override the furnace controller and lower the furnace heat output until the exhaust air temperature is below its set point. Because of heat loss as the exhaust air travels through the exhaust duct, especially once outside the building, this method is imprecise as it does not rely upon actual building temperatures. Also, because air flow though the furnace is at a fixed rate, extremely cold outside air temperatures will likely prevent the furnace from producing air hot enough for optimal drying.

The advanced art of this invention relies on actual building 103 ambient condition measurements for temperature control, blower air volume control and furnace operating temperature management. The furnace heat output is determined by the temperature sensor in sensors unit 117 and sensors unit 120. The building temperature set point is operator selectable. Should cold ambient conditions prevent the furnace from producing air sufficiently hot to achieve the desired building temperature level, the blower 105 volume will be reduced in order to raise the furnace output temperature to its maximum point.

Part of the system and method of the present invention is the use of humidity sensors for process control. The remote sensor unit 117 also includes a humidity sensor 203 for detecting the relative humidity of the air near the sensor. The control signal from the humidity sensor 203 is used by the process control unit 119 to regulate the volume of air produced by blower 105. When humidity levels are high, a high volume of air is needed to "flush" moist air from the building. As the humidity levels fall, the blower speed correspondingly drops until its minimum set point level is reached. The reduced air flow permits more of the furnace's heat output to remain within the building 103 and accelerate evaporation. Reduced air flow will also conserve energy.

The blower 105 air volume may also be controlled in response to an operator overriding predetermined temperature humidity set points such as from a remote sensor located at the furnace duct (not shown). In this manner, the air blower motor 105 can operate at a constant speed in a manual mode. In yet another embodiment, a plurality of air flow sensors can also be used for modulating the supply blower air volume, either independently, or in combination with timers, temperature sensors, air pressure sensors, and humidity sensors.

The system and method of the present invention allow for the portable and autonomous exhaust blower 114 to be placed anywhere within the building 103 or be left in the trailer. This offers more options for controlling air flow and reducing the amount of flexible duct needed. The primary control signal used by the exhaust blower's controller is from the differential air pressure sensor located within the exhaust blower 114 control panel. As per the operator's selection, the exhaust blower control unit works to control the speed of the exhaust blower 114 to create positive, negative, or neutral air pressure conditions in the building 103 by exhausting less, more, or equal volumes of air as blown in by the air blower motor 105.

As seen in FIG. 1, the exhaust blower 114 is connected to the remote sensor 117 by a dotted line. This represents an optional signal path from the autonomous exhaust blower 114 to the process controller 119. If so desired, exhaust blower 114 can be controlled by process controller 119. Air flow sensors located in the exhaust air blower 114 and hot air blower 105 air stream can be used to modulate the speed of both and indirectly control building 103 air pressure. The temperature, pressure, and humidity signals relayed from exhaust blower 114 may also be used by the processor controller in combination with information from other sensors, including ambient temperature, humidity, and pressure sensors located on trailer 100, as alternative means of determining actual drying conditions and adjusting air flows and temperatures accordingly to achieve more optimal conditions. The blower may also be operated in a manual mode at a fixed speed. Radiant heat from the furnace and duct work can produce high temperature conditions within the trailer 101. Trailer 101 wall vents alleviate the condition to a limited degree. A unique innovation further reduces heat build up. Fresh air inlet 111, FIG. 1, incorporates a secondary air opening within the trailer which draws air from inside the trailer into the furnace blower 105. Heat energy is recovered and interior trailer temperatures are reduced.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim as my invention:

1. A drying system for use in drying out a water damaged structure comprising:

an indirectly fired furnace for heating outside air prior to its introduction into the water damaged structure;

a supply blower colocated with the indirectly fired furnace for providing transport of air through the indirectly fired furnace;

an autonomous exhaust blower separated from the supply blower within the water damaged structure for removing humid air from the water damaged building structure and venting the humid air into the atmosphere outside the water damaged structure;

at least one remote temperature and humidity sensor for controlling the furnace air temperature and supply blower volume;

a differential air pressure transmitter for controlling volume of moist air removed from the water damaged building at an optimal rate and drying the water damaged structure.

2. A drying system as in claim 1, further comprising:

an air intake filter box attached to the drying system for promoting air circulation within the drying system for regulating its temperature.

3. A drying system as in claim 1, further comprising a control unit connected to the at least one remote sensor for utilizing the data to provide an optimal rate of drying.

4. A drying system as in claim 1, wherein the at least one remote sensor is used for controlling the temperature of the furnace.

5. A drying system as in claim 1, wherein the at least one remote sensor includes at least one from the group of a temperature sensor, relative humidity sensor or air pressure sensor.

6. A drying system as in claim 1, wherein control of the exhaust blower operates autonomously from the furnace and air intake blower.

7. A drying system as in claim 1, wherein the at least one remote is wirelessly connected to a controller via a wireless radio frequency (RF) link.

8. A drying system for removing moisture from a water damaged structure comprising:

a furnace for generating heat;

an air blower colocated with the furnace for blowing substantially hot air into at least one air duct;

an exhaust blower separated from the air blower and located within the water damaged structure for removing substantially moist air to the outside of the water damaged structure;

at least one remote sensor for detecting temperature and humidity of the water damaged structure; and a process controller for detecting data from the at least one remote sensor; and wherein the process controller operates to independently control both the furnace and exhaust blower in order to remove moisture from the water damaged structure and provide drying at an optimal rate.

9. A drying system as in claim 8, further comprising:

an air intake filter box connected with the furnace for drawing in fresh ambient air.

10. A drying system as in claim 9, wherein the intake filter box further operates to add make-up air to air removed from the water damaged structure.

11. A drying system as in claim 8, wherein the at least one remote sensor includes at least one from the group of an air temperature sensor, relative humidity sensor or air pressure sensor.

12. A drying system as in claim 8, wherein the at least one sensor is used to control the temperature of the furnace.

13. A drying system as in claim 8, wherein the exhaust blower is connected with the remote sensor for autonomous controlling of exhaust air removed from the water damaged structure.

14. A drying system as in claim 8, wherein the at least one remote sensor transmits data to the process controller using a radio frequency (RF) link.

15. A method for drying the interior of a water damaged structure comprising the steps of:

supplying hot air from a furnace to the interior of the water damaged structure using a supply blower colocated with the furnace;

exhausting air from the interior of the structure to the exterior of the structure using an exhaust blower located within the interior of the structure;

determining interior conditions of the building though the use of at least one sensor;

utilizing a process controller for interpreting data supplied by the at least one sensor; and independently controlling parameters of the furnace and the exhaust blower using the process controller for providing an optimal rate of drying.

16. A method for drying the interior of a water damaged structure as in claim 15, further including the step of:

autonomously controlling the exhausting air based on data from the at least one sensor.

17. A method for drying the interior of a water damaged structure as in claim 15, wherein the at least one sensor measures at least one of air temperature, relative humidity or air pressure.

18. A method for drying the interior of a water damaged structure as in claim 15, further comprising the step of:

varying the temperature and speed of the furnace by the process controller in order to achieve the optimal rate of drying.

19. A method for drying the interior of a water damaged structure as in claim 15, further comprising the step of:

receiving data from the at least one sensor to the processor controller through the use of a radio frequency (RF) link.

* * * * *